United States Patent [19]

Faid et al.

[11] 4,064,672

[45] Dec. 27, 1977

[54] POST-APPLIED WATERSTOP CONNECTION

[75] Inventors: Robert W. Faid, Westford; William F. Reinhart, Belmont, both of Mass.

[73] Assignee: W. R. Grace & Co., Cambridge, Mass.

[21] Appl. No.: 693,531

[22] Filed: June 7, 1976

[51] Int. Cl.[2] ..... E04C 3/32

[52] U.S. Cl. ..... 52/726; 52/732; 403/313; 403/302

[58] Field of Search ..... 52/396, 732, 586, 726, 52/285, 573; 404/47, 74, 83, 67; 403/301, 306, 313, 309, 302

[56] References Cited

U.S. PATENT DOCUMENTS

| | | | |
|---|---|---|---|
| 2,119,586 | 1/1938 | Kotrbaty | 52/285 |
| 2,867,160 | 1/1959 | Wangerow | 52/396 |
| 3,512,819 | 5/1970 | Morgan et al. | 52/586 |

*Primary Examiner*—James L. Ridgill, Jr.

*Attorney, Agent, or Firm*—William L. Baker; C. Edward Parker

[57] ABSTRACT

Distinct lengths of post-applied waterstop strips are spliced together by wrapping them in contour fitting flexible union shells provided with a solid baffle having a transverse cross-sectional shape identical to that of said strips. Conventional adhesive is placed on all contacting surface and the two-strip assembly is then secured by means of bars and bolts.

6 Claims, 8 Drawing Figures

FIG. 5
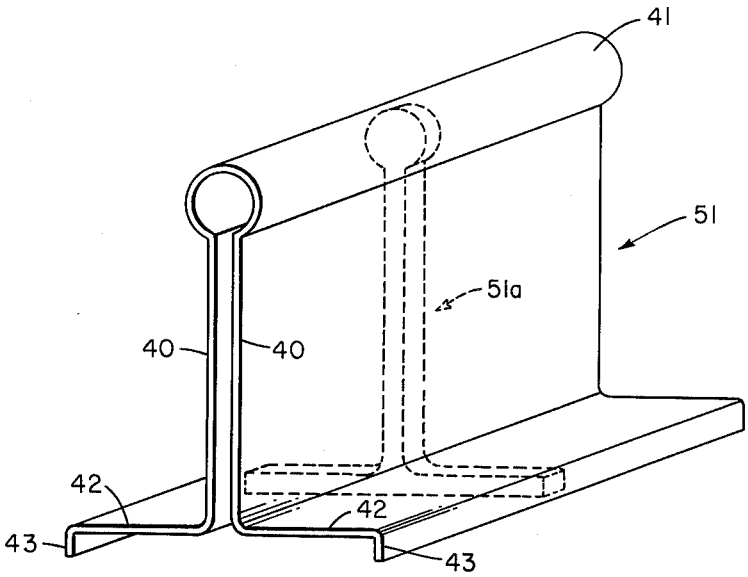
FIG. 5a
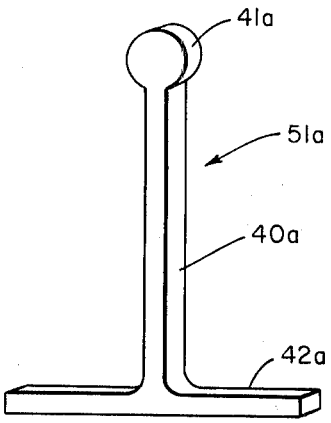
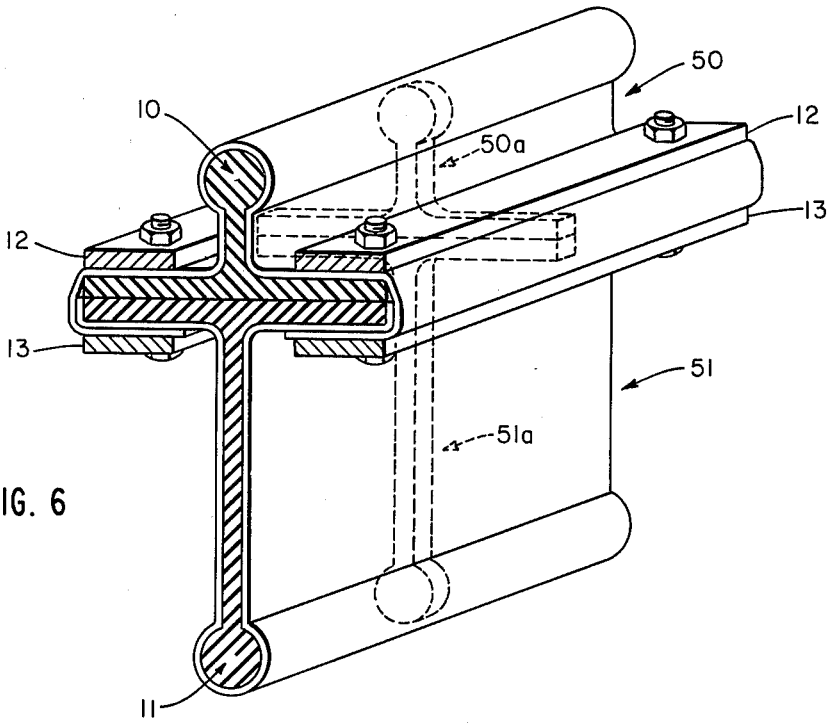
FIG. 6

POST-APPLIED WATERSTOP CONNECTION

The present invention relates to a connector for joining the end portions of adjacent T-shaped post-applied waterstop strip assemblies that are used in concrete structure erected by the slip-forming or jump-forming methods. These "post-applied" waterstops are disclosed in copending application Ser. No. 693,507, filed on June 6, 1976.

The waterstop assemblies that can be joined by the connectors herein disclosed consist essentially of two sealing strips of resilient material, each strip having a T-shaped cross-section. Installation between two concrete masses comprises a first embeddment of one of the sealing strips in the first concrete pour in such a manner that said strip does not protrude beyond the face of the form used to mold the concrete mass. The second strip is then fastened to the embedded strip, i.e. it is post-applied, and the second concrete placement is made.

Figure 1:
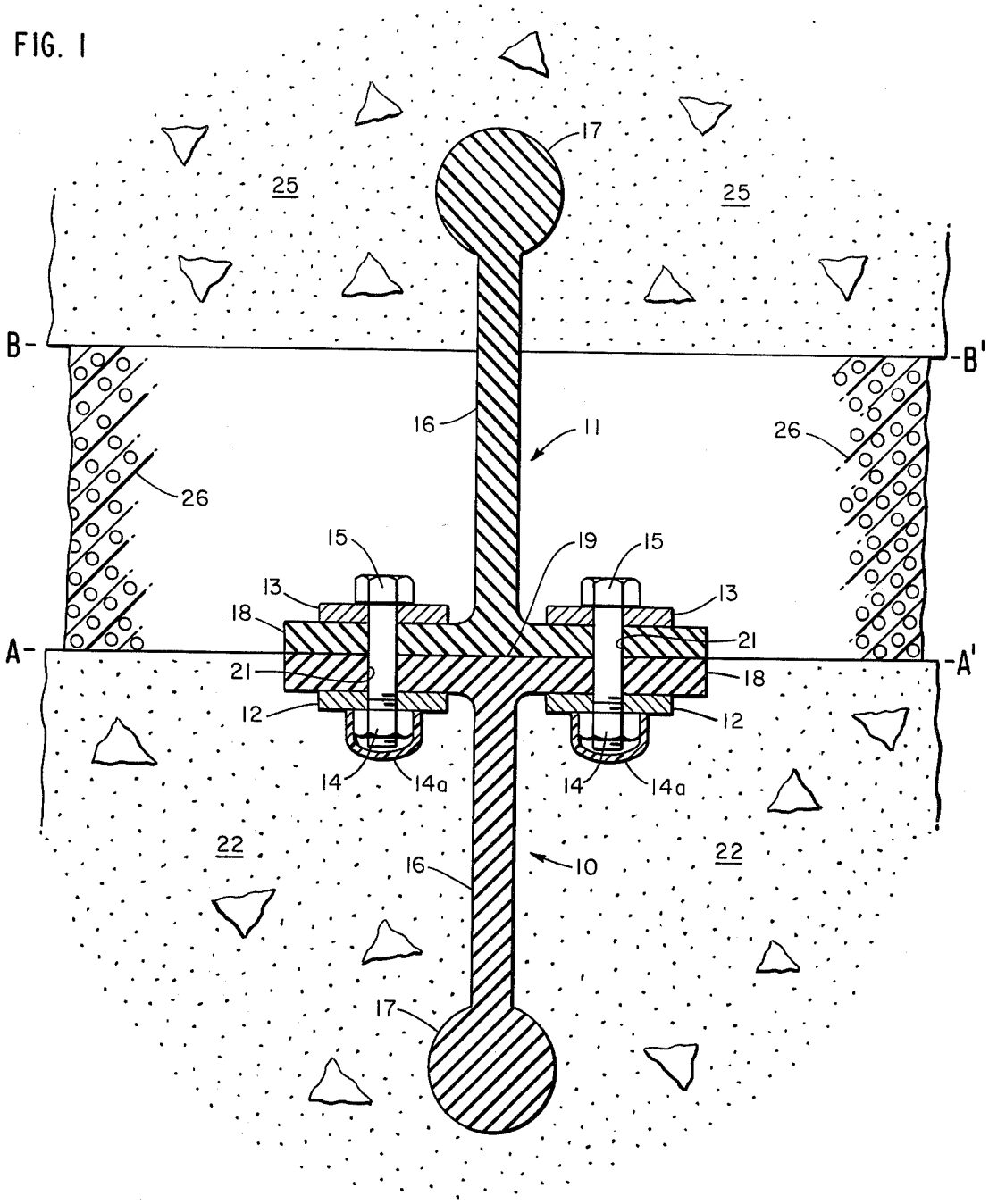
Figure 2:
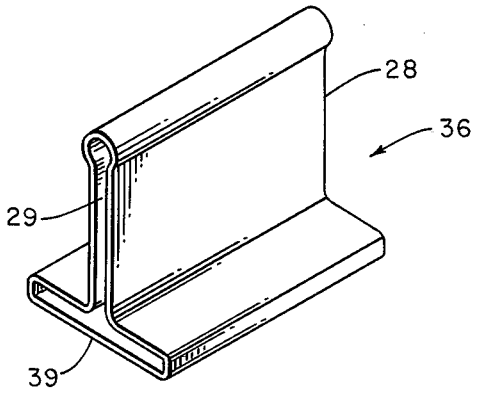

A better idea of the structures involved can be obtained by referring to the drawings, in which FIG. 1 shows in cross-section a waterstop assembly embedded in two adjacent concrete masses;

FIG. 2 shows, also in cross-section, a splicing boot which is disclosed in copending patent application Ser. No. 693,507.

In FIG. 1, there is illustrated an embodiment of an installed post-applied waterstop of the type for which the present splicing system has been devised. This embodiment, viewed in transerve cross-section, consists essentially of two concrete masses, 22 and 25, two sealing strips 10 and 11, perforated metal bars, 12 and 13, and bolts 15 and nuts 14. In the particular embodiment depicted, the first T-shaped strip 10 is fastened by conventional means to the internal face of a jump form (not shown) with metal bars 12 in the positions shown and nuts 14 in welded contact with said bars at regular intervals along the bars. The nuts are covered by caps **14*a* which prevent the fluid concrete from entering perforations 21. After the concrete has been poured and has solidified 22, the jump form is removed and T-shaped sealing strip 11 is attached to sealing strip 10 by means of bolts 15 and bars 13. After resilient lightweight sheeting is placed in space 26 between lines AA' and BB' to save an expansion volume for the concrete masses, the second concrete pour is made to yield mass 25 in which part of the central web 16 and the bulbous end 17 strip 11** are embedded.

THE PRIOR ART

The rubber T-shaped strips 10 and 12 ordinarily come in varying lengths and, when they have to bridge a relatively long joint, they must be joined in end-to-end relationship, with the end portions of adjacent T-shaped strips being sealed to each other in order to provide a continuous barrier at the joint. One method of accomplishing this splicing involves the use of a T-shaped version of the splicing sleeve in U.S. Pat. No. 2,867,160. This type of splicing boot is shown in FIG. 2. In use, one end 28 of this boot 36 is slipped over the end of one of the T-shaped strips e.g. strip 10 of FIG. 1, that will form the waterstop assembly, while the next continuing strip is inserted into the other end 29 of the boot 36. Suitable adhesives are applied to all contacting surfaces in order to complete the connection. The other and opposite sealing strip of the waterstop assembly, e.g. strip 11 of FIG. 1, is similarly joined to a continuing strip of equal cross-sectional dimensions by means of another boot of suitable design. One of the difficulties presented by this type of splicing is due to the layer of material interposed between strips 10 and 11 (of FIG. 1) at the splice, namely the layer formed by the two flat bases 39 of the boots 36. This requires the application of resilient compressible gasketing material between the flat faces of the two strips at the points where the boots begin and end.

A preferred method of connecting said T-shaped strip waterstop assemblies has now been devised which insures the formation of a perfect seal without recourse to the inconvenient and less reliable use of gasketing material.

DESCRIPTION OF THE INVENTION

The splicing elements and system which constitute this invention can best be understood by referring to the following drawings which show, in transverse cross-section:

- a first T-shaped union shell (FIG. 3) and a solid rubber baffle designed to fit in said shell (FIG. **3*a***);
- a preferred embodiment of the first T-shaped union shell (FIG. 4);
- a second T-shaped union shell (FIG. 5) and a solid rubber baffle designed to fit in it (FIG. **5*a***);
- and finally, an assembly of the splicing elements shown in the preceding figures (FIG. 6).

Figure 3:
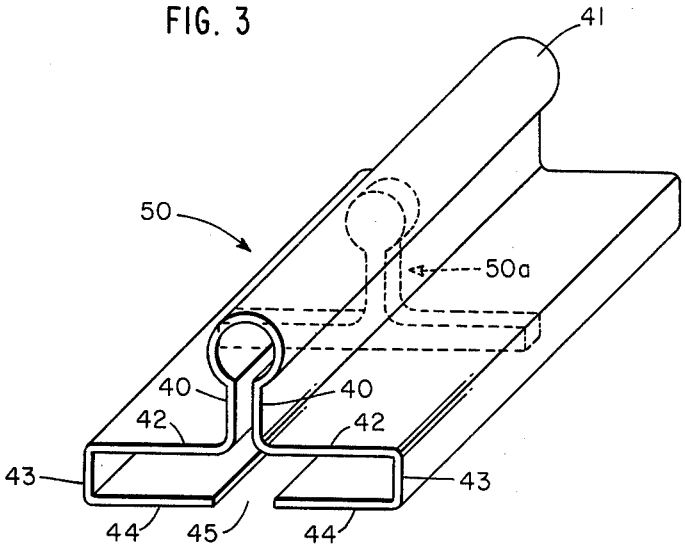
Figure 4:
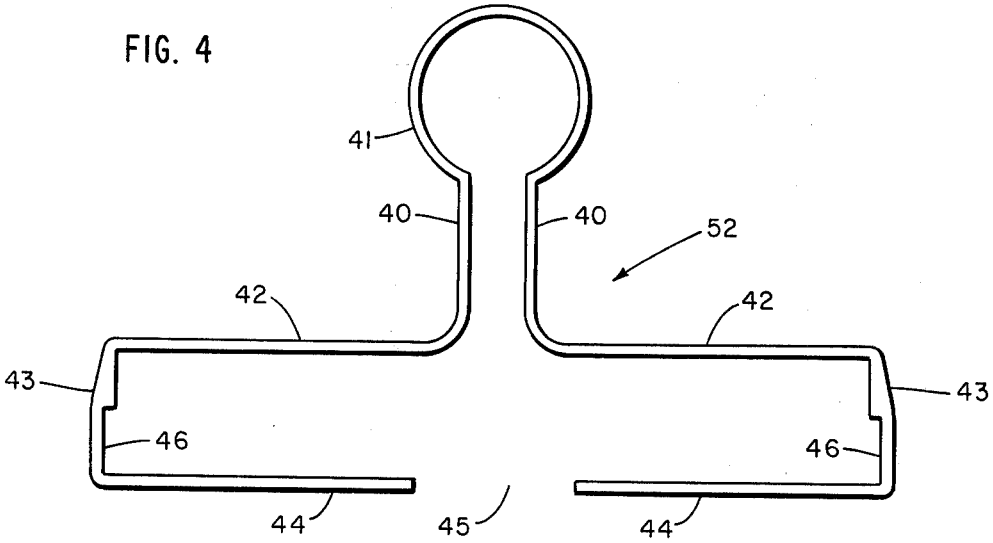

Referring now to the union shells shown in FIGS. 3, 4, and 5, it will be seen that they consist essentially of hollow, thin-walled T-shaped structures shown generally at 50, 51 and 52, having two parallel and opposite vertical walls 40, joined at the top by a tubular portion 41 and terminated at the bottom by flat horizontal wings 42 and vertical walls 43. In the case of the first union shell of FIGS. 3 and 4, additional horizontal walls 44 extend from vertical walls 43 toward the center of the shell. Horizontal walls 44 are parallel to wings 42 and are about equal to them in area. A gap 45 remains between the inner edges of horizontal walls 44 which is sufficiently wide to accomodate, in installed position, central web 16 of T-shaped strip 11 of FIG. 1. There are no horizontal walls 44 attached to vertical walls 43 in the second union shell of FIG. 5. In the preferred embodiment of the first union shell 52 shown in FIG. 4, the lower half inside surface of vertical walls 43 is provided with recessed areas 46 designed to accomodate, in installed position, the vertical walls 43 of the second union shell 51 of FIG. 5.

Figure 3A:
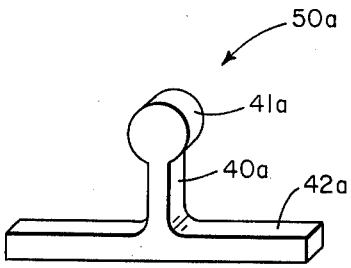

Each union shell is provided with a relatively thin solid T-shaped baffle of appropriate cross-section **50*a* and 51*a* which as seen in FIGS. 3*a* and 5*a*, consists of a central stem 40*a*, a disc-shaped end 41*a* and a horizontal base 42*a* joined to stem 40*a* in T-shaped relationship. These baffles are shaped so that they fit exactly into the hollow interior of the union shells of FIGS. 3, 4 and 5 and may be looked upon as slices of waterstop strips 10 and 11 of FIG. 1**.

In FIG. 6, there can be seen, in transverse cross-section, waterstop strips 10 and 11 of FIG. 1, wrapped in the first union shell 50 of FIG. 3 and the second union shell 51 of FIG. 5. Waterstop strips 10 and 11, as well as the continuing strips, beyond baffles **50*a* and 51*a*, to which they are spliced, not shown, are of indefinite length and have been cut off in this drawing at the point where union shells 50 and 51 end. Similarly, metal bars 12 and 13** which fasten the strips and shells are also cut off at the shell edges.

A suitable conventional adhesive is placed within the splicing assembly between all contacting surfaces.

The union shells of the present splicing system are preferably made of resilient, flexible material in order to facilitate installation around the ends of the waterstop strips to be spliced. Examples of usable substance include styrene-butadiene copolymer, polychloroprene, vinyl resin plastisols, and the like. The shells may possess varying degrees of rigidity, although a fairly rigid unit is preferred for ease of installation.

Having described this invention in terms of the embodiments shown in the drawings, it remains understood that said invention is not limited by any of the details of description, unless otherwise specified, but rather to be construed broadly within the spirit and the scope of the following claims.

What is claimed is:

1. A union shell for splicing T-shaped waterstop strips used in a post-applied waterstop assembly, which is made of thin flexible resilient elastomeric material and comprises, in transverse cross-section: (a) two parallel spaced vertical walls joined together at the top by (b) a bulbous tubular portion, each terminated at the bottom by (c) a flat horizontal wing extending away from the base of each said vertical wall, and (d) a relatively short vertical wall attached to the outer edge of each of said horizontal wings and turning downwardly therefrom, said vertical walls defining a longitudinal gap between the terminal ends thereof in order to accommodate said T-shaped waterstop strips, said shell being hollow except for a thin, solid T-shaped baffle centrally located therein having a stem and a base having essentially the same transverse cross-section as the waterstop strips that said shell is designed to splice and being of such dimension and shape so as to fit snugly in the cavity of said shell.

2. The union shell of claim 1 which comprises further two bottom horizontal walls one each running inward from and attached to a terminal end of each of the relatively short vertical walls in a direction towards one another but stopping short of meeting so as to leave the said longitudinal gap in said shell.

3. A union shell as in claim 1, wherein the lower inner half surface of each of the relatively short lower vertical walls is recessed.

4. A spliced post-applied waterstop assembly comprising, in transverse cross-section:

a. A first pair of longitudinally spliced T-shaped waterstop strips each comprising in transverse cross-section a center web medially and perpendicularly attached to a crossweb, said center web being terminated at its free end by a bulbous enlargement, the spliced ends of said strips being inserted into b. a first union shell made of thin flexible resilient elastomeric material and comprising in transverse cross-section: (1) two parallel spaced vertical walls joined together at the top by (2) a bulbous tubular portion, each terminated at the bottom by (3) a flat horizontal wing extending away from the base of each said vertical wall, and (4) a relatively short vertical wall attached to the outer edge of each of said horizontal wings and turning downwardly therefrom, said vertical walls defining a longitudinal gap between the terminal ends thereof, said center webs and bulbous enlargements of said spliced strips being accommodated within and in sealing relationship with the inner surfaces of said spaced vertical walls and said bulbous tubular portion, respectively, of said union shell, and the terminal end surfaces of said crosswebs and the surfaces of said crosswebs attached to said center webs of said spliced strips being accommodated within and in sealing relationship with the inner surfaces of said short vertical walls and of said wings, respectively, of said first union shell;

c. a second pair of longitudinal spliced T-shaped waterstop strips each also comprising in transverse cross-section a center web, crossweb and bulbous enlargement related as in (a) above, the surfaces of said crosswebs of said second pair of spliced strips opposite the surface attached to said center webs being in sealing relationship with the identical surfaces of the crosswebs of said first pair of spliced waterstop strips along the longitudinal extent thereof, the spliced ends of said second pair of spliced strips being inserted into d. a second union shell also of thin flexible resilient elastomeric material and also having in transverse cross-section spaced vertical walls, bulbous tubular portion, horizontal wings and short vertical walls as recited in (b) above, said second union shell further having in transverse cross-section two bottom horizontal walls one each running inward from and attached to a terminal end of each of said short vertical walls in a direction towards one another but stopping short of meeting so as to leave a longitudinal gap therebetween, said center webs and bulbous enlargements of said second pair of spliced strips being accommodated within and in sealing relationship with the inner surfaces of said spaced vertical walls and said bulbous tubular portion, respectively, of said second union shell, the surfaces of said crosswebs attached to said center webs of said second pair of spliced strips being accommodated within and in sealing relationship with the inner surfaces of said wings of said second union shell, and the inner surfaces of said short vertical walls of said second union shell and the inner surfaces of the bottom horizontal walls attached to the terminal ends thereof enveloping substantially and being in sealing relationship with the outer surfaces of said short vertical walls of said first union shell, and with the outer surfaces of said wings of said first union shell, respectively, the said spaced vertical walls of said first union shell having said center webs of said first pair of spliced strips inserted therein being positioned within the said longitudinal gap left between said two bottom horizontal walls of said second union shell.

5. The spliced assembly of claim 4 wherein a first solid baffle in cross-section having the same cross-sectional configuration of said spliced strips is positioned between the spliced ends of, and is in sealing relationship with, said first pair of spliced waterstop strips, and also a second said baffle is positioned similarly between said second pair of spliced waterstop strips.

6. The spliced assembly of claim 4 wherein the enlarged bulbous portions of said strips surrounded by said union shells are embedded in concrete.

* * * * *